US011486274B2

(12) United States Patent
Mandell et al.

(10) Patent No.: US 11,486,274 B2
(45) Date of Patent: Nov. 1, 2022

(54) VALVE ACTUATION SYSTEM COMPRISING AT LEAST TWO ROCKER ARMS AND A ONE-WAY COUPLING MECHANISM

(71) Applicant: Jacobs Vehicle Systems, Inc., Bloomfield, CT (US)

(72) Inventors: John Mandell, Vernon, CT (US); Matei Alexandru, Somers, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 170 days.

(21) Appl. No.: 16/706,704

(22) Filed: Dec. 7, 2019

(65) Prior Publication Data

US 2020/0182103 A1 Jun. 11, 2020

Related U.S. Application Data

(60) Provisional application No. 62/776,938, filed on Dec. 7, 2018.

(51) Int. Cl.

| | |
|---|---|
| ***F01L 1/26*** | (2006.01) |
| ***F01L 1/24*** | (2006.01) |
| ***F01L 1/18*** | (2006.01) |

(52) U.S. Cl.

CPC ..... *F01L 1/26* (2013.01); *F01L 1/182* (2013.01); *F01L 1/24* (2013.01)

(58) Field of Classification Search

CPC ..... F01L 1/182; F01L 1/18; F01L 1/22; F01L 1/20; F01L 1/24; F01L 1/26; F01L 2001/186; F02F 1/4214; F02F 2001/245

(Continued)

(56) References Cited

U.S. PATENT DOCUMENTS

| | | | |
|---|---|---|---|
| 4,556,025 | A | 12/1985 | Morita |
| 5,107,803 | A | 4/1992 | Furnivall |

(Continued)

FOREIGN PATENT DOCUMENTS

| | | | |
|---|---|---|---|
| DE | 10155800 | A1 | 5/2003 |
| EP | 1418314 | A2 | 5/2004 |

(Continued)

OTHER PUBLICATIONS

International Search Report for International Application No. PCT/US2019/065112 dated Mar. 24, 2020, 4 pages.

(Continued)

*Primary Examiner* — Devon C Kramer
*Assistant Examiner* — Kelsey L Stanek
(74) *Attorney, Agent, or Firm* — Moreno IP Law LLC

(57) ABSTRACT

A valve actuation system comprises at least one main rocker arm operatively connected to a first engine valve, the at least one main rocker arm configured to receive at least main valve actuation motions. A second rocker arm is operatively connected to a second engine valve, the second rocker arm being configured to receive first auxiliary valve actuation motions. The second rocker arm further comprising a hydraulically-controlled first actuator that can selectively couple or decouple the second rocker arm and the second engine valve thereby permitting or preventing conveyance of the first auxiliary valve actuation motions from the second rocker arm to the second engine valve. A one-way coupling mechanism disposed between the at least one main rocker arm and the second rocker arm permits valve actuation motions to be transferred from the at least one main rocker arm to the second rocker arm, but not vice versa.

18 Claims, 18 Drawing Sheets

(58) Field of Classification Search
USPC ..... 123/90.12, 90.15, 90.16, 90.39, 90.44
See application file for complete search history.

(56) References Cited

U.S. PATENT DOCUMENTS

| | | | | |
|---|---|---|---|---|
| 8,936,006 | B2 | 1/2015 | Groth et al. | |
| 9,790,824 | B2 * | 10/2017 | Baltrucki | F01L 13/06 |
| 2002/0017252 | A1 * | 2/2002 | Onoue | F01L 1/267 123/90.2 |
| 2005/0132990 | A1 | 6/2005 | Haas et al. | |
| 2005/0188930 | A1 | 9/2005 | Best | |
| 2005/0274341 | A1 * | 12/2005 | Usko | F01L 1/18 123/90.16 |
| 2012/0024260 | A1 | 2/2012 | Groth et al. | |
| 2013/0306016 | A1 * | 11/2013 | Kato | F01L 1/18 123/90.45 |
| 2014/0245992 | A1 * | 9/2014 | Groth | F01L 1/18 123/321 |
| 2014/0251266 | A1 | 9/2014 | Emmons et al. | |
| 2017/0145876 | A1 | 5/2017 | Pham | |
| 2020/0182097 | A1 * | 6/2020 | Alexandru | F01L 1/18 |

FOREIGN PATENT DOCUMENTS

| | | | | |
|---|---|---|---|---|
| JP | 59115807 | U | * | 8/1984 |
| JP | 59115807 | U | | 8/1984 |
| JP | S60116808 | A | | 6/1986 |
| JP | 6175207 | A | | 8/1986 |
| JP | 61250317 | A | | 11/1986 |
| JP | 63100606 | U | * | 6/1988 |
| JP | 63100606 | U | | 6/1988 |
| JP | H06299819 | A | | 10/1994 |
| JP | H02191805 | A | | 7/1999 |
| JP | 2013253550 | A | | 12/2013 |

OTHER PUBLICATIONS

Written Opinion of the ISA for International Application No. PCT/US2019/065112 dated Mar. 24, 2020, 4 pages.
International Search Report for International Application No. PCT/US2019/065113 dated Mar. 24, 2020, 3 pages.
Written Opinion of the ISA for International Application No. PCT/US2019/065113 dated Mar. 24, 2020, 4 pages.

* cited by examiner

VALVE ACTUATION SYSTEM COMPRISING AT LEAST TWO ROCKER ARMS AND A ONE-WAY COUPLING MECHANISM

CROSS-REFERENCE TO RELATED APPLICATION

The instant application claims the benefit of Provisional U.S. patent application Ser. No. 62/776,938 entitled "VALVE ACTUATION SYSTEM COMPRISING TWO OR THREE TYPE 3 ROCKERS" and filed Dec. 7, 2018, the teachings of which are incorporated herein by this reference. The instant application is also related to application entitled "VALVE ACTUATION SYSTEM COMPRISING TWO ROCKER ARMS AND A COLLAPSING MECHANISM" having Ser. No. 16/706,701, filed on even date herewith.

FIELD

The instant disclosure relates generally to valve actuation systems in internal combustion engines and, in particular, to a valve actuation system comprising at least two rocker arms and a one-way coupling mechanism.

BACKGROUND

Valve actuation systems for use in internal combustion engines are well known in the art. Some valve actuation systems are capable of providing so-called auxiliary valve actuation motions, i.e., valve actuation motions other than or in addition to the valve actuation motions used to operate an engine in a positive power production mode through the combustion of fuel (often referred to as main valve actuation motions). Such auxiliary valve actuation motions include, but are not limited to, compression-release engine braking in which an engine's cylinders are operated in an unfueled stated to essentially act as air compressors, thereby providing vehicle retarding power through the vehicle's drive train. So-called high power density (HPD) compression-release engine braking provides for two compression-release events for each cycle of the engine, which provides increased retarding power as compared to prior art compression-release systems where only a single compression-release event is provided for each cycle of the engine. In such HPD systems, it is necessary to allow the main valve actuation motions to be "lost" (not conveyed to the engine valves) in favor of the auxiliary valve actuation motions that implement the HPD engine braking.

To facilitate loss of the main event motions, HPD valve actuation systems are known to incorporate a collapsing mechanism in a valve bridge, as described in, for example, U.S. Pat. No. 8,936,006 and/or U.S. Patent Application Publication No. 2014/0245992. In these prior art systems, the collapsing mechanism comprises a hydraulically-controlled locking mechanism that, in a mechanically locked state, permits valve actuation motions to be conveyed via the valve bridge and, in a mechanically unlocked state, causes the collapsing mechanism to absorb any applied valve actuation motions thereby preventing their conveyance via the valve bridge.

Furthermore, in order to improve fuel efficiency and reduce tail pipe emission, among other benefits, so-called cylinder deactivation (CDA) is a desirable feature in many internal combustion engines. Collapsing valve bridges may be used for this purpose as well.

However, in some cases, a collapsing mechanism deployed in a valve bridge is not feasible (e.g., due to the lack of sufficient space, the required use of hydraulic lash adjusters or use of a guided valve bridge that cannot accommodate a collapsing mechanism) or a valve bridge is not desired. Consequently, valve actuation systems that facilitate the provision of CDA and/or auxiliary valve actuation such as conventional or HPD engine braking would represent a welcome advancement of the art.

SUMMARY

The above-noted shortcomings of prior art solutions are addressed through the provision of a system for actuating at least two engine valves comprising at least one main rocker arm operatively connected to a first engine valve of the at least two engine valves to actuate the first engine valve, the at least one main rocker arm configured to receive at least main valve actuation motions from a main valve actuation motion source. The system further comprises a second rocker arm operatively connected to a second engine valve of the at least two engine valves to actuate the second engine valve, the second rocker arm being configured to receive first auxiliary valve actuation motions from a first auxiliary valve actuation motion source, the second rocker arm further comprising a hydraulically-controlled first actuator. The hydraulically-controlled first actuator, in a first actuator first state, couples the second rocker arm and the second engine valve thereby permitting conveyance of the first auxiliary valve actuation motions from the second rocker arm to the second engine valve and, in a first actuator second state, decouples the second rocker arm and the second engine valve thereby preventing conveyance of the auxiliary valve actuation motions from the second rocker arm to the second engine valve. The system additionally includes a one-way coupling mechanism disposed between the at least one main rocker arm and the second rocker arm such that the main valve actuation motions are transferred from the at least one main rocker arm to the second rocker arm, and the first auxiliary valve actuation motions are not transferred from the second rocker arm to the at least one main rocker arm. In this embodiment, the system may comprise a hydraulic lash adjuster disposed in a motion imparting end of the at least one main rocker or in a motion imparting end of the second rocker arm.

The one-way coupling mechanism may comprise a first contact surface provided by the at least one main rocker arm and a second contact surface provided by the second rocker arm, wherein the first and second contact surfaces are configured such that the main valve actuation motions cause contact between the first and second contact surfaces, whereas the first auxiliary valve actuation motions do not cause contact between the first and second contact surfaces. In a particular embodiment, the one-way coupling mechanism comprises a first extension extending from the at least one main rocker arm toward second rocker arm and comprising the first contact surface, and a second extension extending from the second rocker arm toward the at least one main rocker arm and comprising the second contact surface. Further still, either the first contact surface or the second contact surface may comprise an adjustable contact surface.

In another embodiment, the at least one main rocker arm comprises a first rocker arm configured to actuate the first engine valve, wherein the one-way coupling mechanism is disposed between the first rocker arm and the second rocker arm. Further, the at least one main rocker arm comprises a third half-rocker arm configured to receive the main valve actuation motions from the main valve actuation motion source. Further still in this embodiment, the at least one main rocker arm comprises a collapsing mechanism configured, in a first collapsing mechanism state, to couple the, third half-rocker arm and the first rocker arm thereby permitting conveyance of the main valve actuation motions from the third half-rocker arm to the first rocker arm and, in a second collapsing mechanism state, to decouple the third half-rocker arm and the first rocker arm thereby preventing conveyance of the main valve actuation motions from the third half-rocker arm to the first and second rocker arm. The collapsing mechanism may be disposed in the third half-rocker arm, in which case the first rocker arm comprises a collapsing mechanism contact surface. Alternatively, the collapsing mechanism may be disposed in the first rocker arm. Regardless, the collapsing mechanism may comprise a locking mechanism.

In this other embodiment, the third half-rocker arm may comprise a resilient element contact surface configured to cooperatively engage with a resilient element for biasing the third half-rocker arm into contact with the main valve actuation motion source. Additionally, the first rocker arm may comprise a half-rocker arm as well. A resilient element may be disposed between the third half-rocker arm and the first rocker arm to bias the third half-rocker arm into contact with the main valve actuation motion source. In this case, a travel limiter configured to limit travel of the resilient element to limit loading placed on the first rocker arm may also be provided.

Additionally, in this other embodiment, the first rocker arm may be configured to receive second auxiliary valve actuation motions from a second auxiliary valve actuation motion source. In this case, the first rocker arm may further comprise a hydraulically-controlled second actuator configured, in a second actuator first state, to couple the first rocker arm and the first engine valve thereby permitting conveyance of the second auxiliary valve actuation motions from the first rocker arm to the first engine valve and, in a second actuator second state, to decouple the first rocker arm and the first engine valve thereby preventing conveyance of the second auxiliary valve actuation motions from the first rocker arm to the first engine valve.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
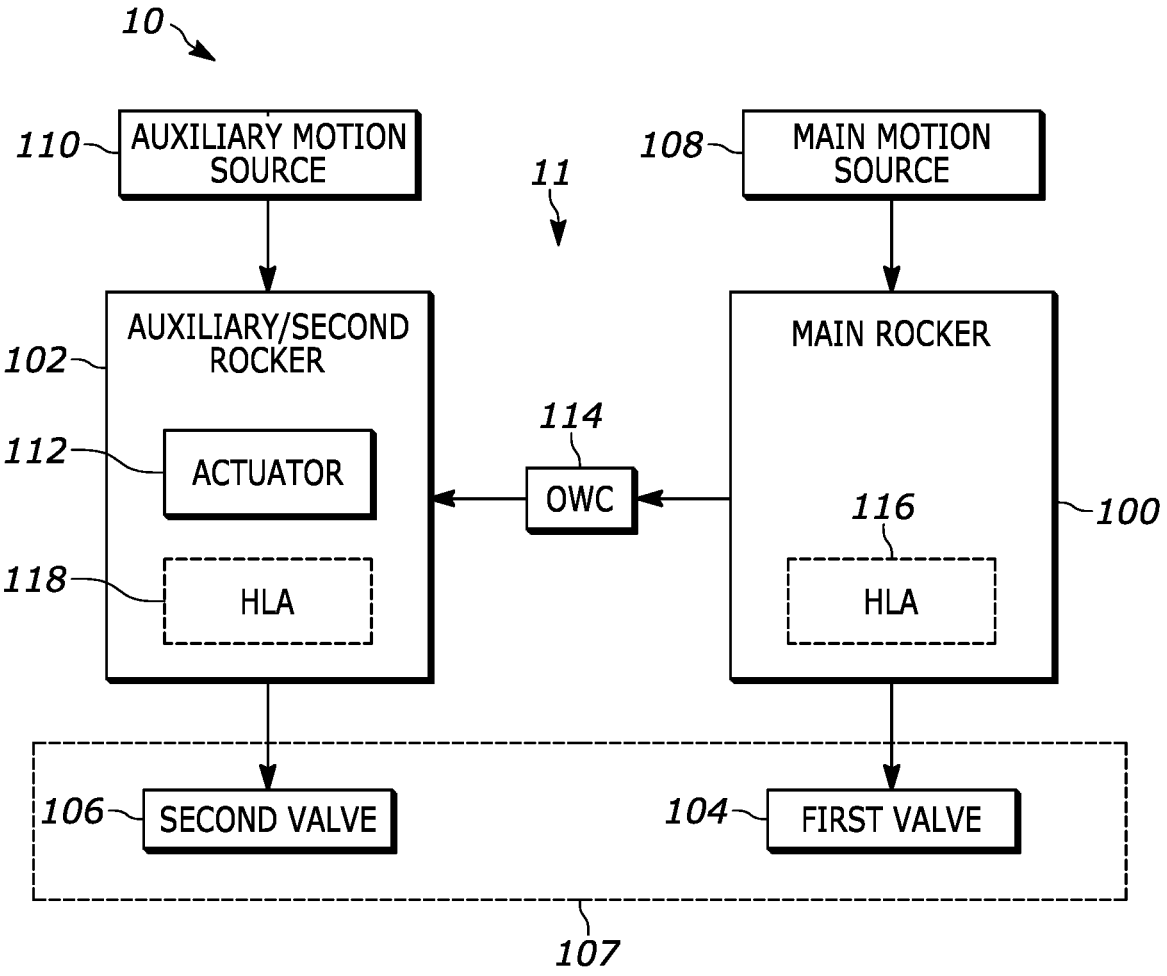
FIG. 1 is a schematic illustration of a valve actuation system in accordance with a first embodiment of the instant disclosure.

FIG. 1 schematically illustrates a first embodiment of a valve actuation system 11 comprising a main rocker arm 100, an auxiliary or second rocker arm 102 and a one-way coupling mechanism 114. As indicated by the unidirectional arrows between the main rocker arm 100, the one-way coupling mechanism 114 and the auxiliary/second rocker arm 102, the main rocker arm 100 is capable of driving the auxiliary/second rocker arm 102, but not vice versa. The main rocker arm 100 is configured to receive valve actuation motions from a main motion source 108 (e.g., a cam, etc.) and is operatively connected to a first engine valve 104, whereas the auxiliary rocker arm 102 is configured to receive valve actuation motions from an auxiliary motion source 110 and is operatively connected to a second engine valve 106, where the first and second engine valves 104, 106 (associated with a cylinder 107 of an internal combustion engine 10). As known in the art, the engine valves 104, 106 may comprise intake valves, exhaust valves or auxiliary valves and, in an embodiment, separate valve actuation systems 11 can be separately provided for different engine valve types associated with a single cylinder, e.g., one instance of a valve actuation system 11 for intake valves of a cylinder and another instance of a valve actuation system 11 for exhaust valves of that same cylinder. As used herein, the descriptor "main" refers to valve actuation motions that are used during a positive power generation state of operation of the engine. On the other hand, as used herein, the descriptor "auxiliary" refers to valve actuation motions that are used during a state of engine operation that is in addition to or in place of positive power generation, e.g., for various types of engine braking, late intake valve closing (LIVC), early exhaust valve opening (EEVO), etc.

Further, in this embodiment, the auxiliary/second rocker arm 102 is provided with a first actuator 112, for example, a hydraulically-activated actuator that may be selectively controlled to extend out of, or retract into, the auxiliary rocker arm 102. The first actuator 112 may be controlled (e.g., in its extended state, or a first actuator first state) to selectively transfer valve actuation motions received from the auxiliary valve actuation motion source 110 to the second valve 106, or controlled (e.g., in its retracted state, or a first actuator second state) to prevent transmission of such motions by establishing lash space between the actuator and another component in the auxiliary valve train. Thus, the first actuator 112 may be configured to extend toward/retract from either the auxiliary motion source 110 or the second engine valve 106. In the former case, the first actuator 112 may be disposed in a motion receiving end of the auxiliary/ second rocker arm 102 and, in the latter case, the first actuator 112 may be disposed in a motion imparting end of the auxiliary/second rocker arm 102.

Because the coupling between the main rocker arm 100 and the auxiliary/second rocker arm 102 is one-way only, the main valve actuation motions from the main motion source 108 are conveyed to both the first and second valves. Simultaneously, through control of the first actuator 112, the auxiliary valve actuation motions from the auxiliary motion source 110 may be transmitted to only the second valve 106. In this manner, auxiliary valve actuation motions can be added to the main valve actuation motions to implement any of a number of desirable engine operating states. As used herein, the term "coupled" refers to sufficient communication between components such that at least a portion of valve actuation motions applied to one of the components are conveyed to the other component without necessarily requiring a fixed or two-way connection, and the term "decoupled" refers to a lack of or insufficient communication between components such that valve actuation motions are not conveyed via those components. Thus, for example, components that simply contact each other may be coupled to the extent that conveyance of valve actuation motions from one component to another is achieved. Alternatively, components that contact each other but that do not result in transmission of valve actuation motions from one component to another are decoupled. As yet another alternative, decoupling can result from the establishment of a sufficient amount of clearance or lash space between two components such that all valve actuation motions applied to one of the components are lost prior to transmission to the other component. However, the establishment of lash space between two component that still results in the transmission of some, but not all, applied valve actuation motions are still considered as a coupling between those components.

As noted, the first actuator 112 may be controlled to extend out of, or retract into, the auxiliary/second rocker arm 102. To this end, and where the first actuator 112 comprises a hydraulic actuator, a control system (not shown) may be provided that comprise a suitable engine control unit (ECU), as known in the art, in communication with one or more high-speed solenoids, also as known in the art. In this case, the ECU may control a high-speed solenoid to provide hydraulic fluid to, or to restrict flow of hydraulic fluid to, the first actuator 112, thereby controlling the first actuator's operating state. To the extent that a given engine 10 may comprise multiple valve actuation systems 11 (corresponding to separate valve types in a single cylinder and/or across multiple cylinders in the engine), the ECU may communicate for this purpose with a single solenoid that controls hydraulic fluid to a plurality of valve actuation systems 11, or multiple solenoids that each control individual valve actuation systems 11 or sub-groups of valve actuation systems 11.

Furthermore, the system 11 may comprise one or more hydraulic lash adjusters 116, 118 associated with either the first or second engine valves 104, 106 or both. As known in the art, a hydraulic lash adjuster will often include a hollow, sliding plunger operated by a hydraulic fluid, such as engine oil. When an engine valve is closed (i.e., no valve actuation motions are being applied to the engine valve), the automatic lash adjuster associated therewith may be free to fill with the hydraulic fluid that is continuously supplied thereto, expanding the automatic lash adjuster and thereby taking up any lash space in the valve train for the engine valve as it expands. When the lash adjuster is loaded (i.e., when valve actuation motions are being applied to the engine valve), the fluid supply to the hydraulic lash adjuster may be blocked and fluid pressure of the trapped volume of hydraulic fluid within the automatic lash adjuster prevents the plunger from collapsing. In this manner, the automatic lash adjuster is able to take up any lash space between components used to actuate an engine valve. In an embodiment, the one or more hydraulic lash adjusters 116, 118 are provided in a motion imparting end of the main rocker arm 100 and/or the auxiliary/second rocker arm 102. However, those skilled in the art will appreciate that such hydraulic lash adjusters 116, 118 may be disposed essentially anywhere along the valve trains associated with the first and/or second engine valves 104, 106.

Figure 2:
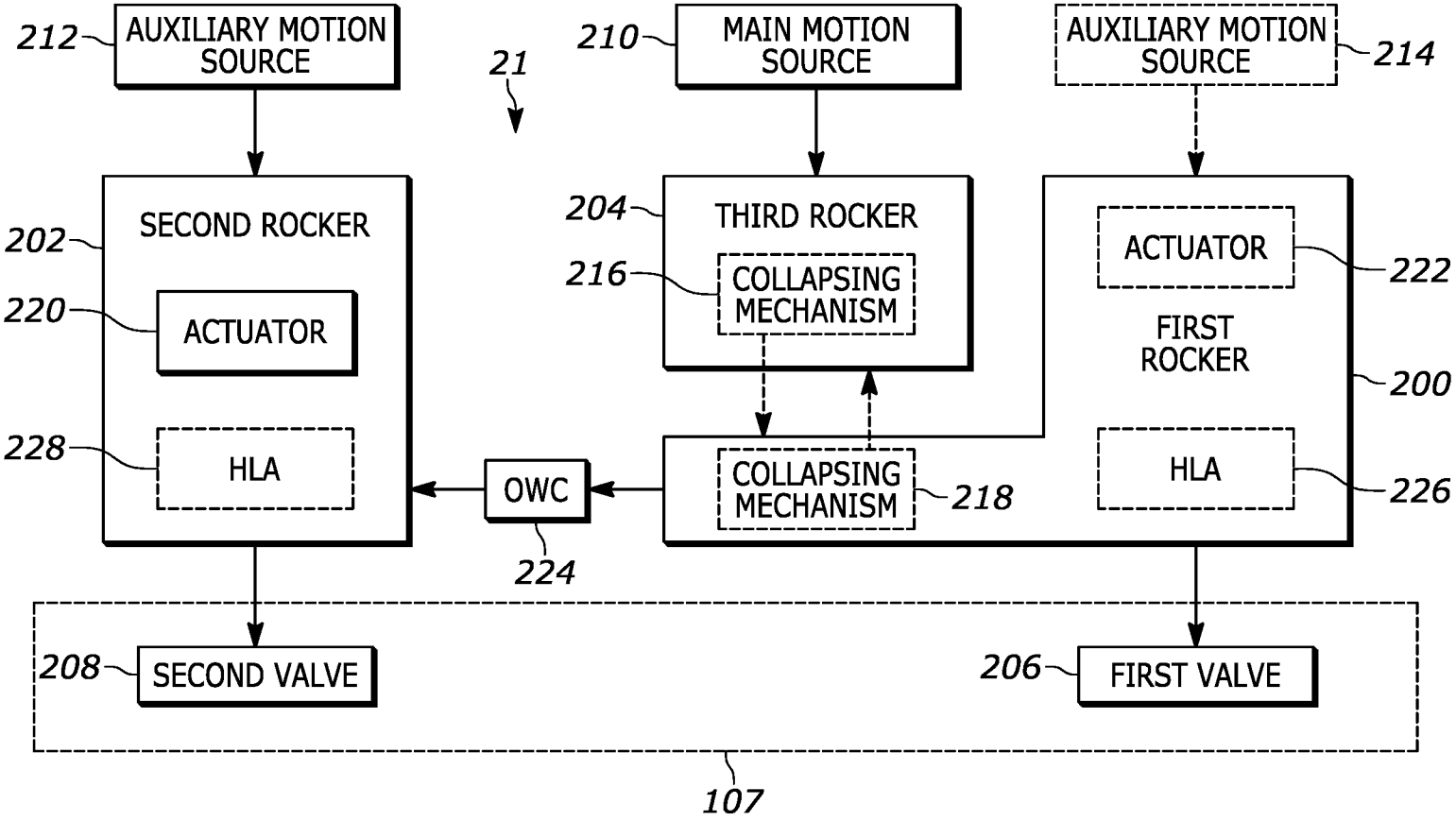
FIG. 2 is a schematic illustration of a valve actuation system in accordance with a second embodiment of the instant disclosure.

Referring now to FIG. 2, a second embodiment of a valve actuation system 21 is schematically illustrated and comprises respective first, second and third rocker arms 200, 202, 204. In this system 21, as compared to the system 11 of FIG. 1, the main rocker arm 100 is effectively provided by a combination of the first rocker arm 200, the third rocker arm 204 and a collapsing mechanism 216, 218 as described in further detail below. In alternate embodiments, the first rocker arm 200 may comprise either a half- or full-rocker arm. In the former case, the first rocker arm 200 does not directly receive any valve actuation motions from a valve actuation motion source whereas, in the latter case, the first rocker arm 200 may be configured to receive valve actuation motions from an optional (second) auxiliary valve actuation motion source 214. Regardless, as shown, the first rocker arm 200 is configured to contact a first engine valve 206. On the other hand, the third rocker arm 204 is a half-rocker arm configured to receive valve actuation motions from a main valve actuation motion source 210. In this embodiment, a collapsing mechanism 216, 218 may be provided in either the first or third rocker arms 200, 204 (but not both). The collapsing mechanism 216, 218 operates to selectively couple/decouple the first and third rocker arms 200, 204. In the coupled state (or first collapsing mechanism state), valve actuation motions from the main motion source 210 are transferred via the third rocker arm 204 to the first rocker arm 200, whereas in the decoupled state (or second collapsing mechanism state), no motions are transferred from the third rocker arm 204 to the first rocker arm 200. The collapsing mechanism 216, 218 may comprise a hydraulically-actuated locking mechanism of the type described in U.S. Pat. No. 9,790,824, the teachings of which are incorporated herein by this reference (an example of which are illustrated below with reference to FIG. 8). Alternatively, rather than relying on a mechanically locking mechanism, the collapsing mechanism 216, 218 could be implemented using a control valve, as known in the art, to create a trapped volume of hydraulic fluid that causes a piston or similar component to be rigidly maintained in an extended position, but that otherwise retracts when the trapped volume of hydraulic fluid is released. Further, those skilled in the art will appreciate that the collapsing mechanism 216, 218 need not be restricted to hydraulically-actuated devices but could instead be implemented pneumatically or electromagnetically.

Because all main valve actuation motions are lost when the collapsing mechanism 216, 218 is operated to decouple the first and third rocker arms 200, 202, and presuming that a similar configuration is used for both intake and exhaust valves of a corresponding cylinder, the cylinder can be maintained in a deactivated state, i.e., incapable of producing positive power.

Further, in the embodiment of FIG. 2, the first rocker arm 200 is optionally provided with a second actuator 222, for example, a hydraulically activated actuator that may be selectively controlled to extend out of, or retract into, the first rocker arm 200. When the first rocker arm 200 is configured to receive valve actuation motions from the optional auxiliary motion source 214, the second actuator 222 may be configured to interact with either the optional auxiliary motion source 214 or the second engine valve 206, i.e., disposed in either a motion receiving end or a motion imparting end of the first rocker arm 200, respectively. The second actuator 222 may be controlled (e.g., in its extended state, or a second actuator first state) to selectively transfer valve actuation motions received from the optional auxiliary valve actuation motion source 214 to the first valve 206, or controlled (e.g., in its retracted state, or a second actuator second state) to prevent transmission of such motions by establishing lash space between the actuator and another component in the auxiliary valve train.

The second rocker arm 202 is configured to receive auxiliary valve actuation motions (apart from the auxiliary motions provided by the optional auxiliary motions source 214, when provided), which may be selectively passed to a second engine valve 208, or lost, through operation of a first actuator 220 (identical to the first actuator 112 illustrated in FIG. 1, including operation in the first actuator first state and the first actuator second state). The first actuator 220 may also comprise a hydraulically-activated actuator as described above. As shown, the one way coupling mechanism 224 may be provided between the first rocker arm 200 and the second rocker arm 202 such that main or auxiliary valve actuation motions received by the first rocker arm (either directly or indirectly) are conveyed to the second rocker arm 202, but auxiliary valve actuation motions applied to the second rocker arm 202 by the auxiliary motion source 212 are not conveyed to the first rocker arm 200. Thus, the second engine valve 208 will always receive any valve actuation motions applied to the first rocker arm 200 (by either the main motion source 210 or the optional auxiliary motion source 214), and may also selectively convey valve actuation motions received from the auxiliary motion source 212.

Consequently, a number of different operating states may be achieved using the system of FIG. 2 depending on its configuration and the state of the collapsing mechanism 216, 218 and the first and second actuators 220, 222. For example, when the optional auxiliary motion source 214 is not provided (nor, most likely, the second actuator 222), operation of the collapsing mechanism 216, 218 in its second collapsing mechanism state (i.e., uncoupled) prevents main valve events from being provided to the first and second engine valves 206, 208. Additionally, in this case, if the first actuator 220 is also maintained in its retracted state (first actuator second state), the valve motions from the auxiliary motion source 212 are likewise not conveyed to the second engine valve 208, thus deactivating the cylinder. If only the collapsing mechanism 216, 218 is activated (collapsing mechanism first state), then only valve events from the main motion source 210 are passed to the engine valves 206, 208. Further still, if the collapsing mechanism 216, 218 is collapsed (collapsing mechanism second state) but the first actuator 220 is extended (first actuator first state), then only valve actuation motions from the auxiliary motion source 212 are applied to the second engine valve 208. Finally, if both the collapsing mechanism 216, 218 and the first actuator 220 are activated (collapsing mechanism first state and first actuator first state, respectively), then valve actuation motions from the main motion source 210 are passed on to both the first and second engine valves 206, 208, whereas the valve motions from the auxiliary motion source 212 are passed on to only the second engine valve 208. When the optional auxiliary motion source 214 and the second actuator 222 are provided, the above-described operating states may be further selectively augmented (through operation of the second actuator 222 in the second actuator first state) with the addition of auxiliary motions from the optional auxiliary motion source 214 applied to both the first and second engine valves 206, 208.

As in the case of FIG. 1, the collapsing mechanism 216, 218 may be controlled to couple/decouple the first and third rocker arms 200, 204, i.e., to operate in first and second collapsing mechanism states as described above, using the above-described control system. The first and second actuators 220, 222 may likewise be controlled by the control system to transfer valve actuation motions received from the auxiliary valve actuation motion source 212 (and, if provided, the optional auxiliary valve actuation motion source 214) to the engine valves 206, 208, or to prevent transmission of such motions (i.e., to lose them). Further, as shown, the system 21 may include one or more hydraulic lash adjusters 226, 228, preferably in a motion imparting end of the first rocker arm 200 and/or the second rocker arm 202. However, once again, those skilled in the art will appreciate that such hydraulic lash adjusters 226, 228 may be disposed essentially anywhere along the valve trains associated with the first and/or second engine valves 206, 208.

Figure 3:
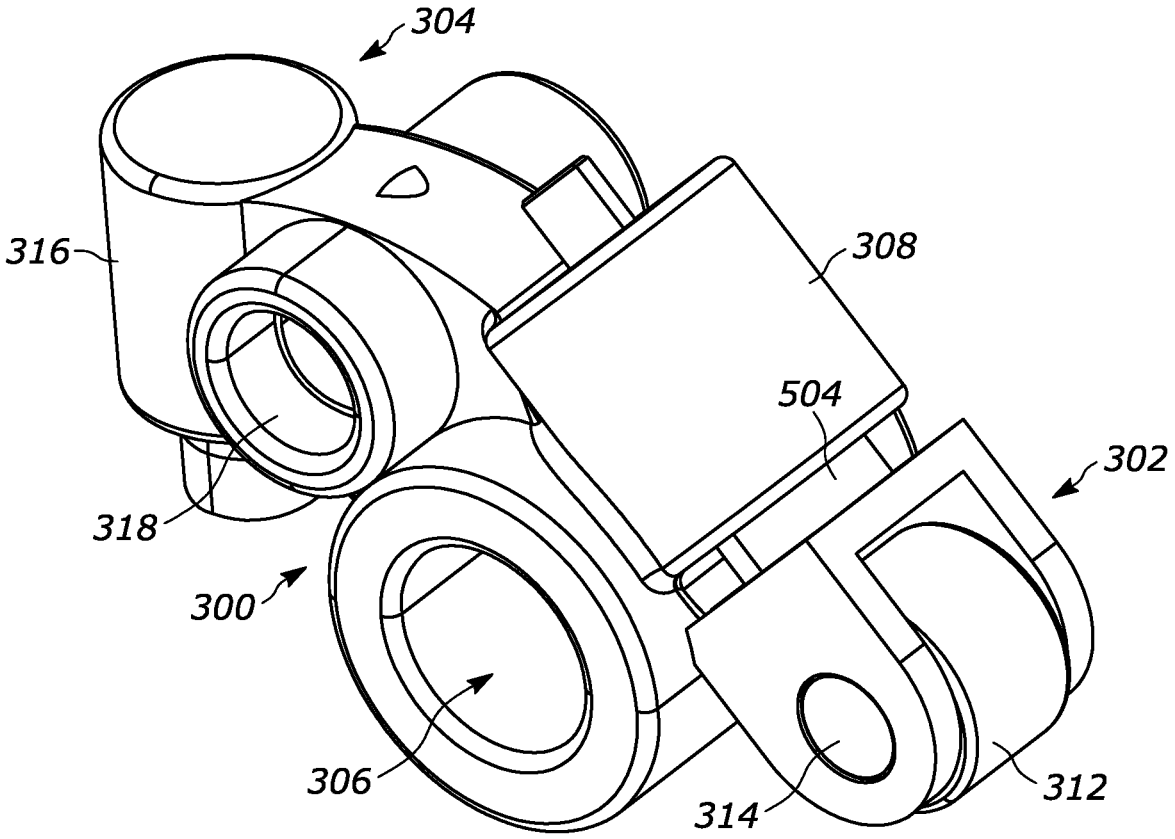
FIGS. 3-5 are respective top left isometric, top right isometric and side cross-sectional views of an auxiliary or second rocker arm in accordance with the instant disclosure.
Figure 4:
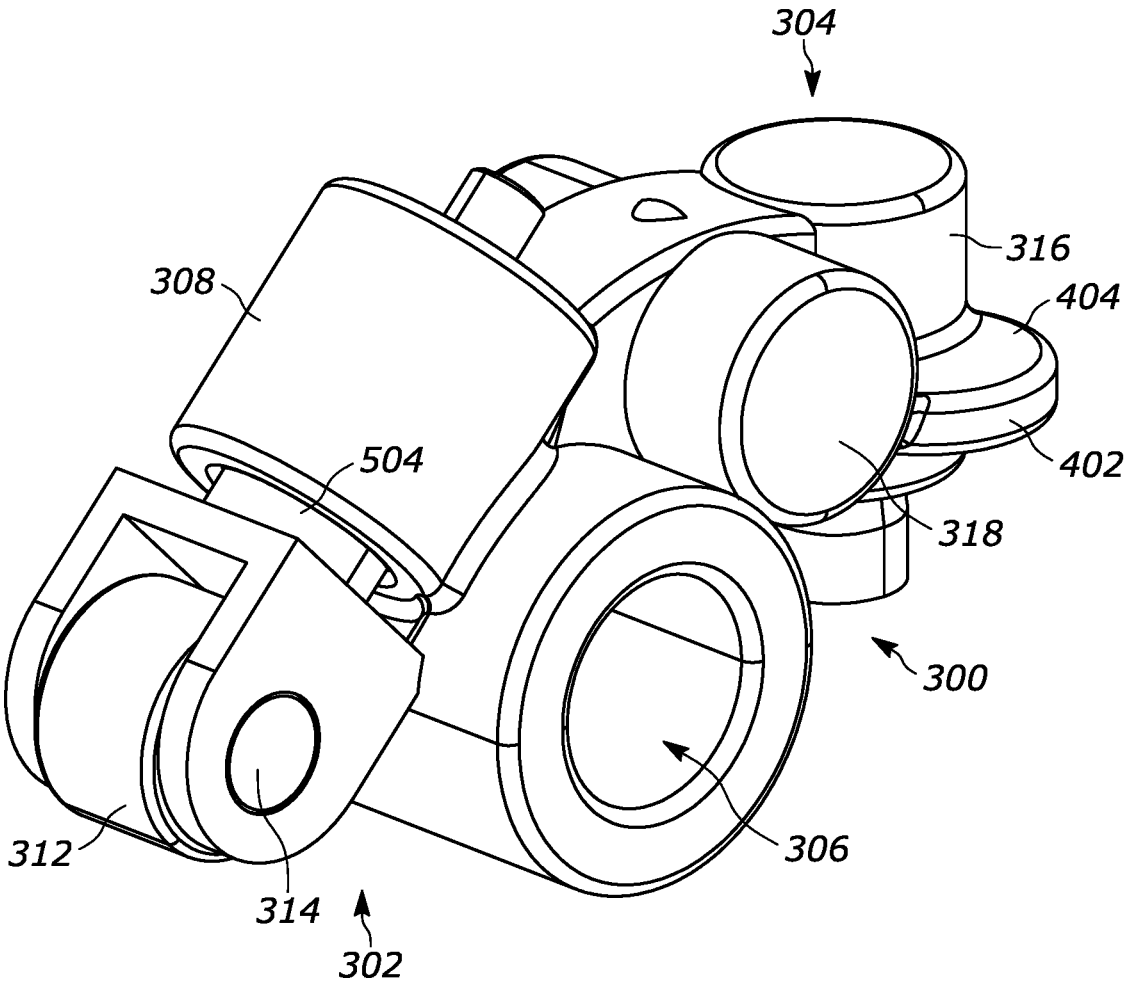
Figure 5:
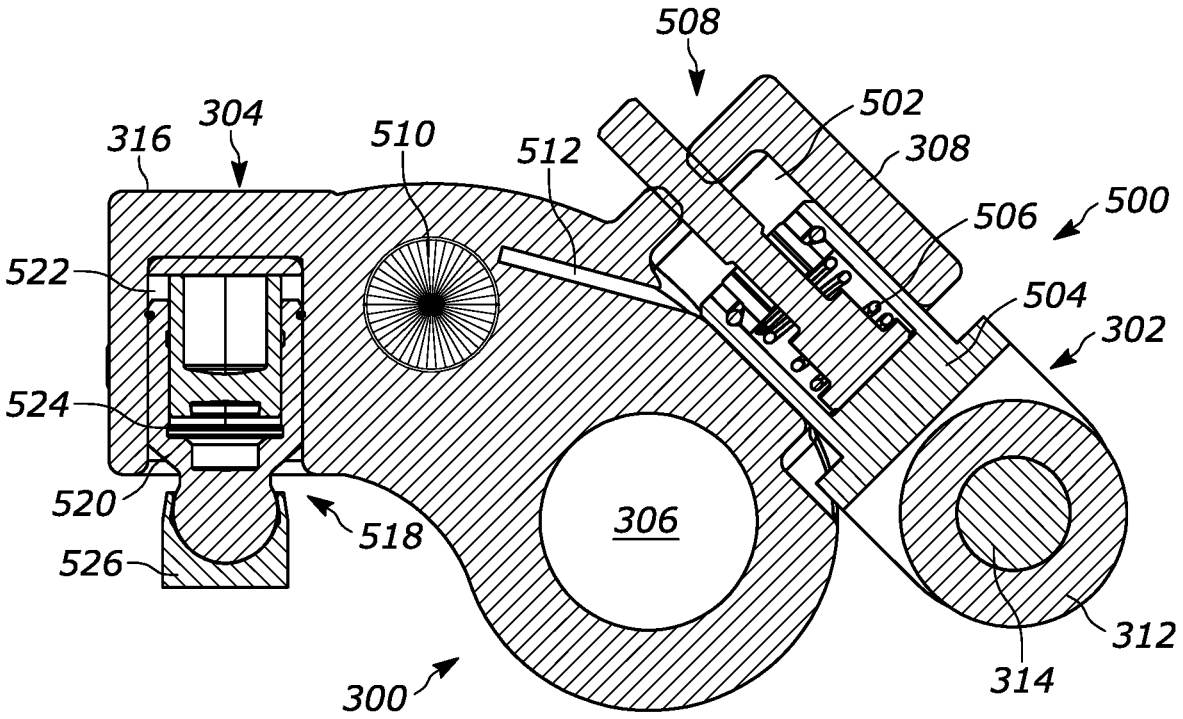
Figure 6:
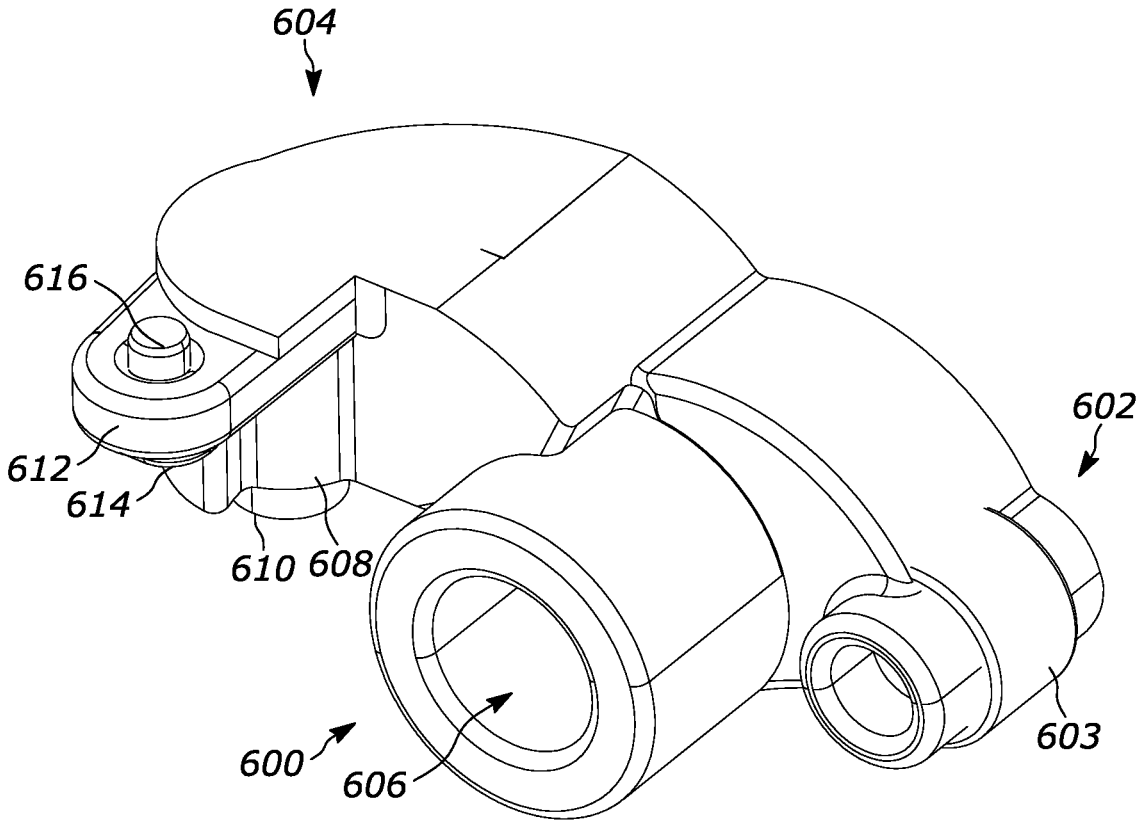
FIG. 6 is a top left isometric view of an embodiment of a main rocker arm in accordance with the instant disclosure.
Figure 7:
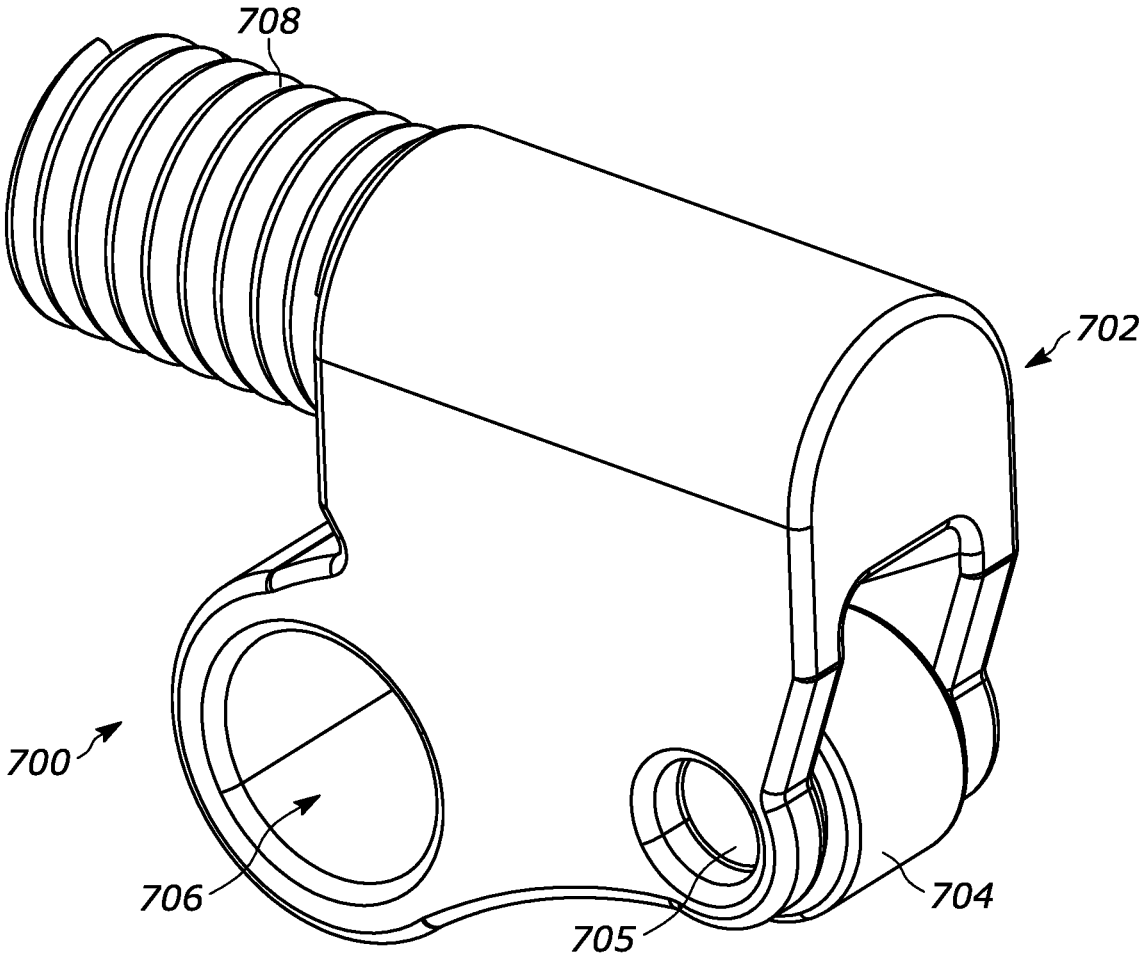
FIGS. 7 and 8 are respective top left isometric and side cross-sectional views of a third rocker arm in accordance with the instant disclosure.
Figure 8:
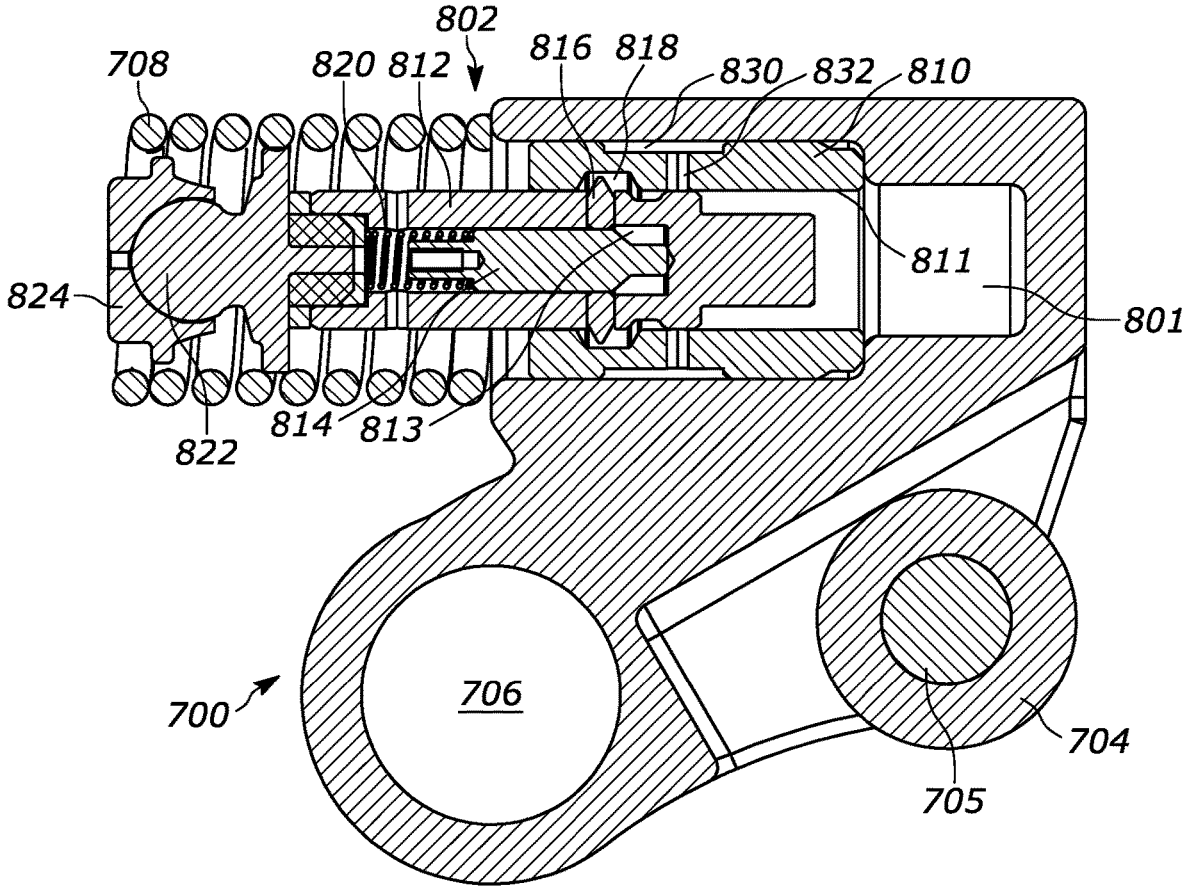
Figure 9:
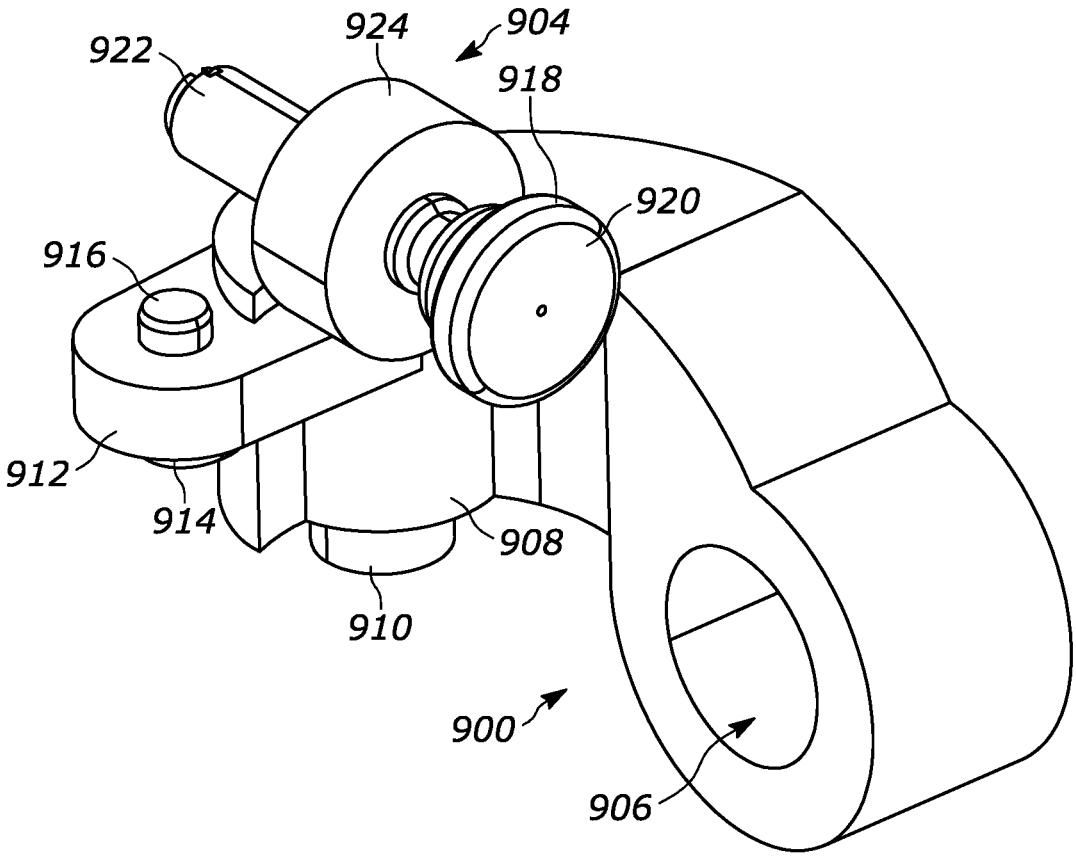
FIG. 9 is a top left isometric view of a first embodiment of a first rocker arm in accordance with the instant disclosure.
Figure 10:
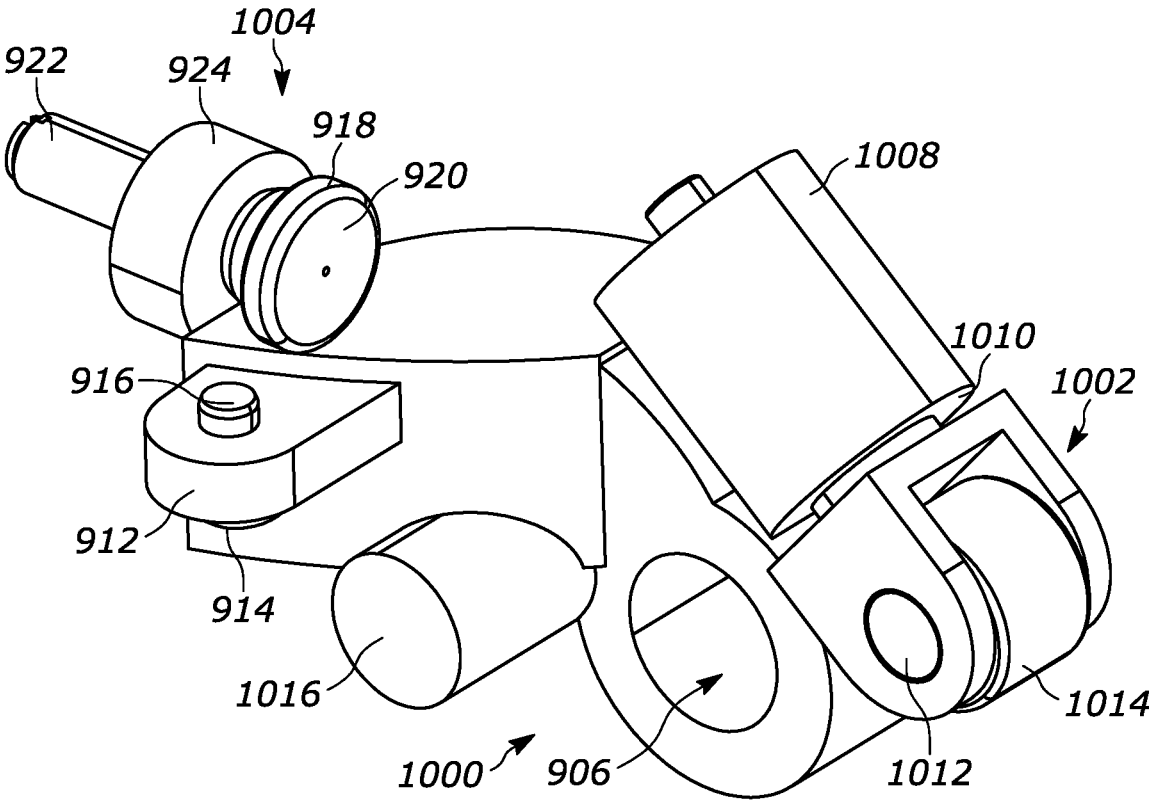
FIG. 10 is a top left isometric view of a second embodiment of a first rocker arm in accordance with the instant disclosure.

Relative to FIGS. 1 and 2, various rocker arms 100, 102, 200, 202, 204 may be used to implement the valve actuation systems 11, 21. FIGS. 3-10 provide examples of implementations of these various rocker arms. In particular, FIGS. 3-5 illustrate an embodiment of the auxiliary/second rocker arm 102, 202; FIG. 6 illustrates an embodiment of the main rocker arm 100; FIGS. 7 and 8 illustrate an embodiment of the third rocker arm 204; FIG. 9 illustrates a first embodiment of the first rocker arm 200; and FIG. 10 illustrates a second embodiment of the first rocker arm 200.

Referring now to FIGS. 3-5, an auxiliary/second rocker arm 300 comprises a motion receiving end 302 and a motion imparting end 304. Between the motion receiving and imparting ends 302, 304, a rocker shaft opening 306 is provided configured to receive a rocker shaft (not shown) and thereby permit reciprocal motion of the rocker arm 300 about the rocker shaft. In the illustrated embodiment, the motion receiving end 302 of the rocker arm 300 comprises a first actuator boss 308 having a first actuator 500 (as best shown in FIG. 5) disposed therein. The first actuator 500 supports an axle 314 having a roller follower 312 mounted thereon for receiving auxiliary valve actuation motions from an auxiliary valve actuation motion source 110, 212. The motion imparting end 304 comprises a hydraulic lash adjuster boss 316 having a hydraulic lash adjuster 518 (as best shown in FIG. 5) disposed therein.

Referring to FIG. 5, the first actuator 500 resides in an bore 502 formed in the actuator boss 308 and comprises an actuator piston 504 slidably disposed in the actuator bore 502. As shown, a manual lash adjustment assembly 508 is provided in the bore 502 and the actuator piston 504 is biased into the bore 502 by an actuator bias spring 506 interposed between the lash adjustment assembly 508 and the actuator piston 504. Additionally, a control valve 510 is provided in the second rocker arm 300. As known in the art, hydraulic fluid may be routed to the actuator bore 502 via the control valve 510 and hydraulic passages 512 (partially shown) connecting the first actuator bore 502 to the control valve 510. When hydraulic pressure is applied to the bore 502 via the control valve 510, the actuator piston 506 extends from the bore 502 and is rigidly maintained in this extended position (i.e., the first actuator first state) by virtue of a locked volume of hydraulic fluid provided by a control valve 510, as known in the art. On the other hand, the absence of hydraulic pressure applied to the control valve 510 (and, consequently, the bore 502) releases the locked hydraulic fluid thereby permitting the actuator piston 504 to slide freely within the bore 502 (i.e., the first actuator second state).

As further shown in FIG. 5, the hydraulic lash adjuster 518 resides in a bore 522 formed in the hydraulic lash adjuster boss 316 and comprises a lash adjuster piston 520 disposed in the bore 522. That end of the lash adjuster piston 520 extending out of the bore 522 is equipped with a swivel 526 configured to contact the second engine valve 106, 208. As known in the art, one or more hydraulic passages (not shown) in the rocker arm 300 provide a continuous supply of hydraulic fluid to the bore 522. When the hydraulic lash adjuster 518 is unloaded, the hydraulic fluid can flow past a check valve (not shown) to a pressure chamber 524 that causes the lash adjuster piston 520 to extend out of the bore 522 to the extent possible and establishes the locked volume of hydraulic fluid as described above.

Finally, as best shown in FIG. 4, the rocker arm 300 comprises an extension 402 at its motion imparting end 304 extending laterally away from the rocker arm 300. An upper surface 404 of the extension 402 establishes a contact surface that, as described in further detail below, permits the rocker arm 300 to receive valve actuation motions from another rocker arm, but not to convey valve actuation motions to the other rocker arm. Thus, the extension 402 forms a portion of the one-way coupling mechanism 114, 224.

Referring now to FIG. 6, a main rocker arm 600 comprises a motion receiving end 602 and a motion imparting end 604. Between the motion receiving and imparting ends 602, 604, a rocker shaft opening 606 is provided configured to receive a rocker shaft (not shown) and thereby permit reciprocal motion of the rocker arm 600 about the rocker shaft. In the illustrated embodiment, the motion receiving end 602 of the rocker arm 600 comprises a roller follow 603 for receiving valve actuation motions from a main valve actuation motion source 108.

The motion imparting end 604 of the rocker 600 comprises a hydraulic lash adjuster boss 608 having a hydraulic lash adjuster 610 similar to the boss 316 and hydraulic lash adjuster 518 described above. As further shown, the rocker arm 600 comprises an extension 612 at its motion imparting end 604 extending laterally away from the rocker arm 600. A lower surface 614 of the extension 612 establishes a contact surface that, as described in further detail below, permits the rocker arm 600 to convey valve actuation motions to another rocker arm, but not to receive valve actuation motions to the other rocker arm. Thus, the extension 612 forms a portion of the one-way coupling mechanism 114. In this particular embodiment, the extension 612 comprises an adjustable contact surface 616 (also shown in FIGS. 12, 15 and 18) that allows the lower surface of 614 of the extension 612 to be adjusted. Alternatively, particularly where a hydraulic lash adjuster is incorporated into the valve actuation system, the contact surface 616 can be fixed, i.e., non-adjustable.

Referring now to FIGS. 7 and 8, a third rocker arm 700 comprises a half-rocker in that it only includes a motion receiving end 702 having an axle 705 and roller follower 704 mounted thereon for receiving valve actuation motions from a main valve actuation motion source 210. As further illustrated, a rocker shaft opening 706 is provided configured to receive a rocker shaft (not shown) and thereby permit reciprocal motion of the rocker arm 700 about the rocker shaft.

As best shown in FIG. 8, the third rocker arm 700 comprises a collapsing mechanism 802 disposed within a bore 801 formed in the third rocker arm 700, which collapsing mechanism 802 establishes contact with a collapsing mechanism contact surface of another rocker arm described below. In particular, the collapsing mechanism 802 illustrated in FIG. 8 is a hydraulically-actuated locking mechanism comprising a housing 810 disposed in the bore 801. The housing 810 is fixedly retained in the housing bore 801, for example, through a threaded engagement, interference fit or slip fit with a retaining ring between the housing 810 and housing bore 801. Although the housing 810 is provided in the illustrated embodiment, it is understood that the features of the housing 810 described herein could be provided directly in the body of the third rocker arm 700. Regardless, in turn, the housing 810 comprises a bore 811 having an outer plunger 812 slidably disposed therein. An end of the outer plunger 812 extending out of the bore 801 is terminated by a cap 822 having a ball 822 and swivel 824, which collectively establish contact with a collapsing mechanism contact surface described below. The outer plunger 812 also has a bore 813 with an inner plunger 814 slidably disposed therein. In the illustrated embodiment, a locking spring 820 biases the inner plunger 814 into the outer plunger bore 813. So long as the biasing force provided by the locking spring 820 is unopposed, the inner plunger 814 is biased into the outer plunger bore 813 thereby causing locking elements 816 to extend through openings formed in sidewalls of the outer plunger 812. As further shown, the housing 810 has an outer recess 818 formed in an inner wall thereof. When the locking elements 816 are extended and aligned with the outer recess 818, the outer plunger 812 is mechanically prevented from sliding within the housing bore 811, i.e., it is locked relative to the housing 810, such that the outer plunger 812 is maintained in an extended position regardless of any valve actuation motions applied to the third rocker arm 700. Consequently, any valve actuation motions applied to third rocker arm 700 are conveyed via the collapsing mechanism 802 and collapsing mechanism contact surface to another rocker arm (not shown), i.e., the collapsing mechanism 802 is operated in the first collapsing mechanism state.

The housing 810 also comprises an annular channel 830 formed on an outer sidewall surface thereof and radial openings 832 extending through the sidewall thereof that may receive hydraulic fluid from passages (not shown) formed in the first rocker arm 204. The hydraulic fluid thus supplied may be further routed into the outer plunger bore 813 (via openings in the outer plunger 813 not shown) such that the pressure applied by the hydraulic fluid counteracts the bias provided by the locking spring 820 and further causes the inner plunger 814 to slide out of the outer plunger bore 813. As it does so, a reduced-diameter portion of the inner plunger 814 aligns with the locking elements 816, thereby permitting the locking elements 816 to retract and disengage with the outer recess 818. In this state, the outer plunger 812 is permitted to slide further into the housing bore 811, i.e., it is unlocked. Consequently, any valve actuation motions applied to third rocker arm 700 are not conveyed via the collapsing mechanism 802 to another rocker arm to the extent that such motions simply cause the outer plunger 812 to reciprocate within the housing bore 810, i.e., the collapsing mechanism 802 is operated in the second collapsing mechanism state.

As further shown in FIGS. 7 and 8, a resilient element 708 (such as a compression spring, as shown) may be provided to bias to the third rocker arm 700 and urging the third rocker arm 700 into contact with the main valve actuation motion source. As best shown in FIG. 8, the resilient element 708 is disposed about the outer plunger 812, cap 822, ball 822 and swivel 824 and further abuts the third rocker arm 700 at one end, whereas the other end of the resilient element 708 abuts another rocker arm (not shown). Thus configured, the resilient element 214 biases the first rocker arm 204 away from second rocker arm 206 and into contact with the motion source. In an embodiment, a travel limiter may be provided to ensure that the third rocker arm 700 does not apply excessive loading on the main motion source, e.g., a cam base circle. This may be provided through the use of a fixed surface (i.e., unmoving relative to the reciprocation of the third rocker arm 700) configured to limit rotation of the third rocker arm 700 toward the main motion source.

Referring now to FIG. 9, a first embodiment of a first rocker arm 900 is illustrated in which the first rocker arm is a half-rocker having only a motion imparting end 904. A rocker shaft opening 906 is provided to receive a rocker shaft (not shown) and thereby permit reciprocal motion of the rocker arm 900 about the rocker shaft. Similar to the embodiment of FIG. 6, the motion imparting end 904 of the rocker 900 comprises a hydraulic lash adjuster boss 908 having a hydraulic lash adjuster 910. As further shown, the rocker arm 900 comprises an extension 912 at its motion imparting end 904 extending laterally away from the rocker arm 900. A lower surface 914 of the extension 912 establishes a contact surface that, as described in further detail below, permits the rocker arm 900 to convey valve actuation motions to another rocker arm, but not to receive valve actuation motions to the other rocker arm. Thus, the extension 912 forms a portion of the one-way coupling mechanism 224. In this particular embodiment, the extension 912 comprises an adjustable contact surface 616 (also shown in FIGS. 12, 15 and 18) that allows the lower surface of 914 of the extension 912 to be adjusted. Alternatively, particularly where a hydraulic lash adjuster is incorporated into the valve actuation system, the contact surface 916 can be fixed, i.e., non-adjustable.

As further shown in FIG. 9, the motion imparting end 904 further comprises an upwardly-extending flange or boss 924 that supports a bolt 922 and swivel 918. In turn, the swivel 918 defines a collapsing mechanism contact surface 920 that is configured and positioned to make contact with the corresponding swivel 824 forming a part of the collapsing mechanism 802. In various embodiments, the bolt 922 may be either fixed or adjustable.

Referring now to FIG. 10, a second embodiment of a first rocker arm 1000 comprises features substantially similar to those illustrated in FIG. 9 as indicated by the same reference numerals. However, unlike the embodiment of FIG. 9, the second embodiment of a first rocker arm 1000 is a full-rocker in that it also includes a motion receiving end 1002. Furthermore, in the illustrated embodiment, the motion receiving end 1002 of the rocker arm 1000 comprises a second actuator boss 1008 having a second actuator 1010 disposed therein. The second actuator 1010 supports an axle 1012 having a roller follower 1014 mounted thereon for receiving auxiliary valve actuation motions from an optional auxiliary valve actuation motion source 214.

Figure 11:
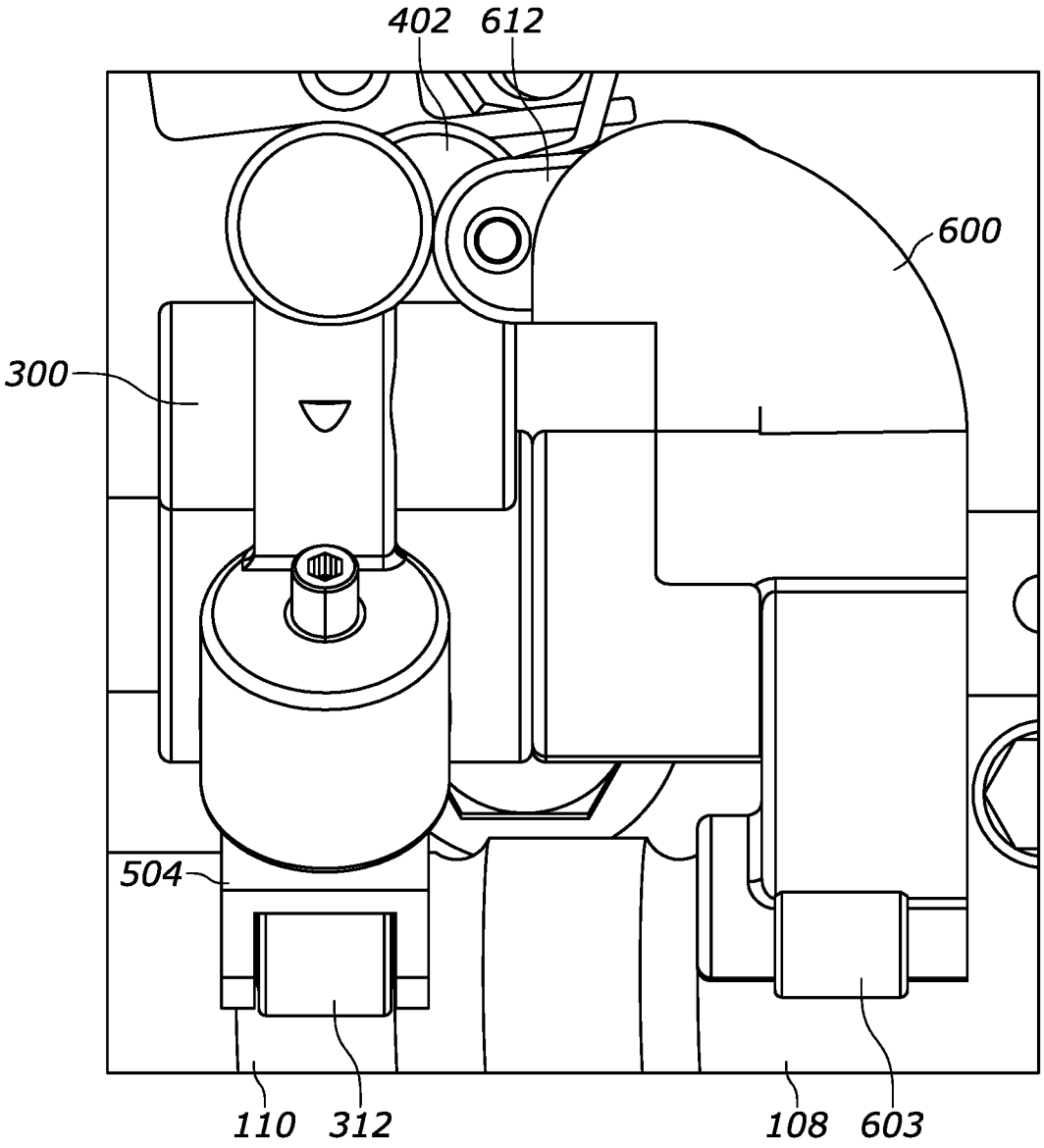
FIGS. 11 and 12 are respective top and rear views of an example of a valve actuation system in accordance with the embodiments of FIGS. 1 and 3-6.
Figure 12:
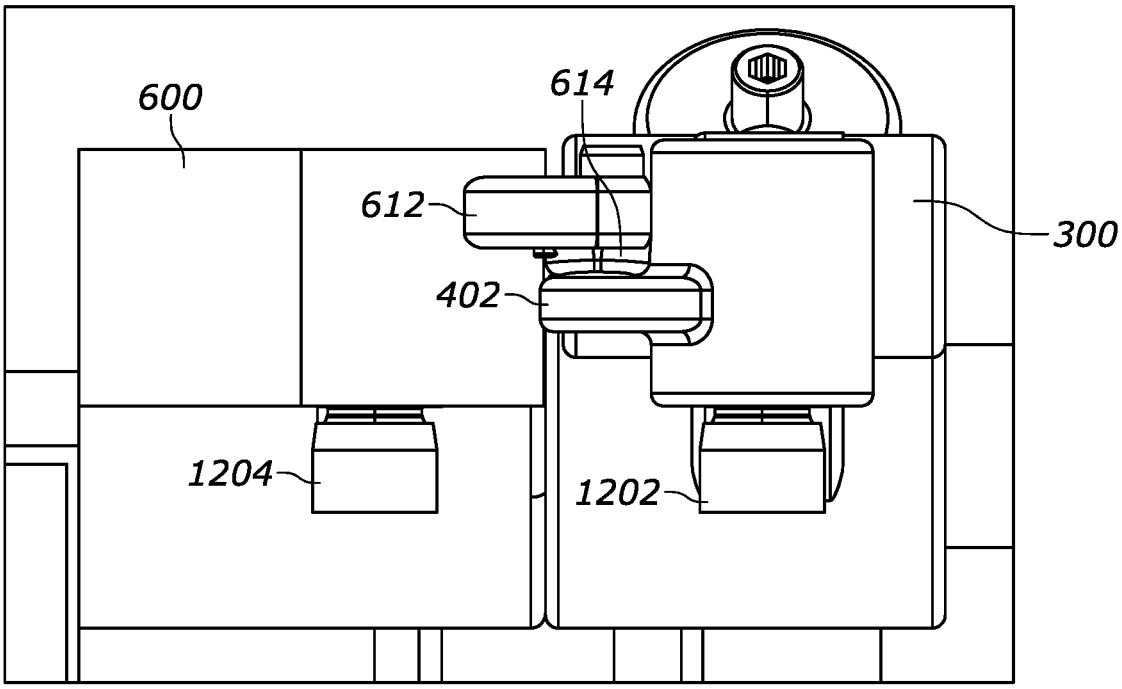

An example of a valve actuation system in accordance with the system illustrated in FIG. 1 and the rocker implementations of FIGS. 3-6 is further illustrated with regard to FIGS. 11 and 12. As shown, the main rocker arm 600 and auxiliary/second rocker arm 300 each comprise, at their motion receiving ends, a suitable follower 603, 312 configured to receive valve actuation motions from the valve actuation motion sources 108, 110 in the form of cams residing on a camshaft, as known in the art. As described above, the roller follower 312 for the auxiliary/second rocker 300 resides on the first actuator 504. At their motion imparting ends, the rockers 300, 600 each comprises a suitable pivoting element or swivel 1202, 1204 configured to engage the respective first and second engine valves (not shown), which swivels 1202, 1204 are mounted on corresponding hydraulic lash adjusters. As further shown, both the main rocker arm 600 and auxiliary/second rocker 300 each comprise a respective extension 612, 402, as described above, extending toward the other rocker. As best shown in FIG. 3, the main rocker extension 612 is positioned above and overlaps with the auxiliary rocker extension 402. An adjustable contact surface 614 is provided between the extensions 612, 402. Configured in this manner, the main rocker arm 600 is capable of transferring motions to the auxiliary/second rocker 300 but the auxiliary/second rocker arm 300 cannot transfer motions to the main rocker arm 100.

Figure 13:
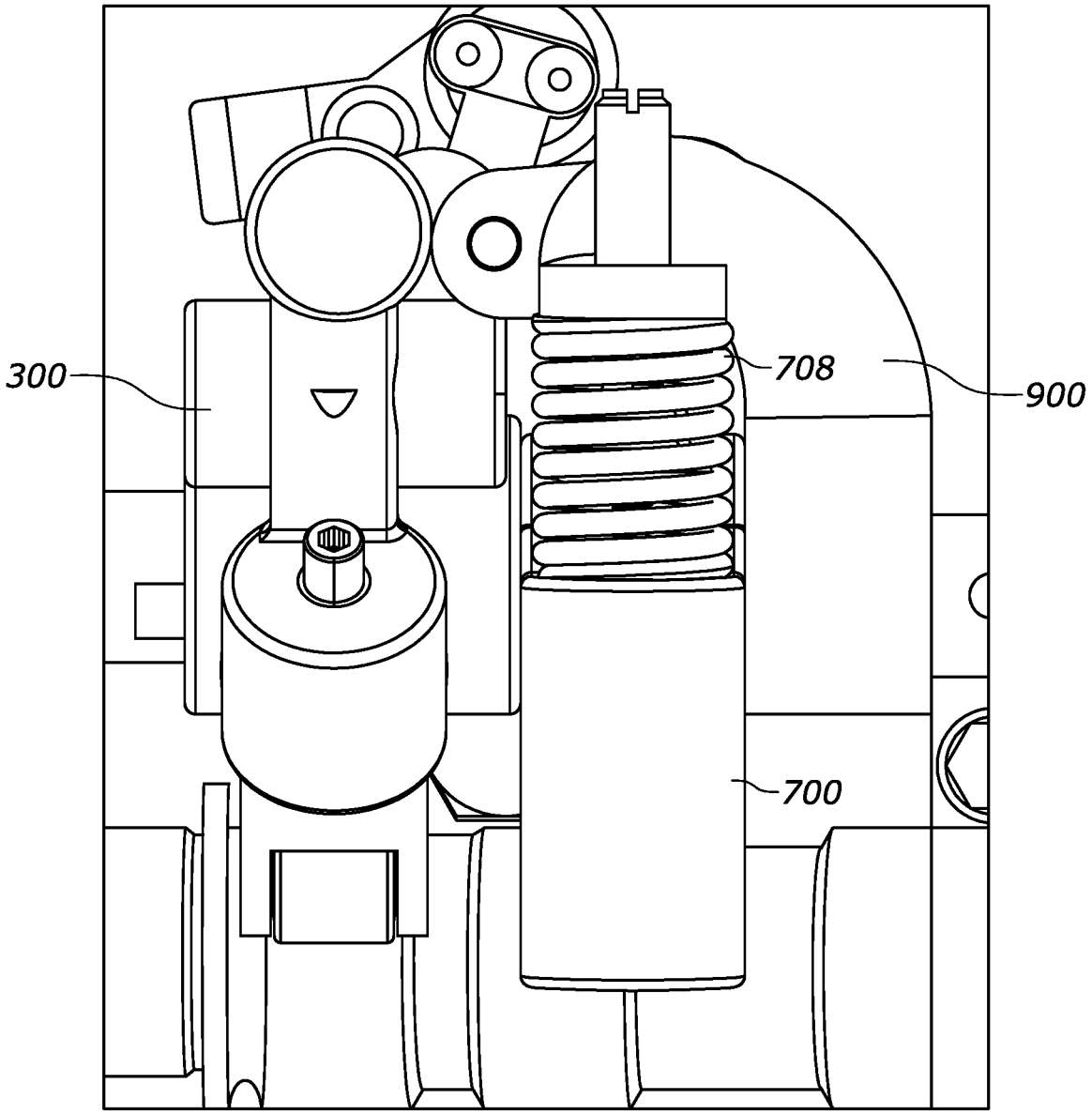
FIGS. 13-15 are respective top, rear and front views of a first example of a valve actuation system in accordance with the embodiments of FIGS. 2, 3-5 and 7-9.
Figure 14:
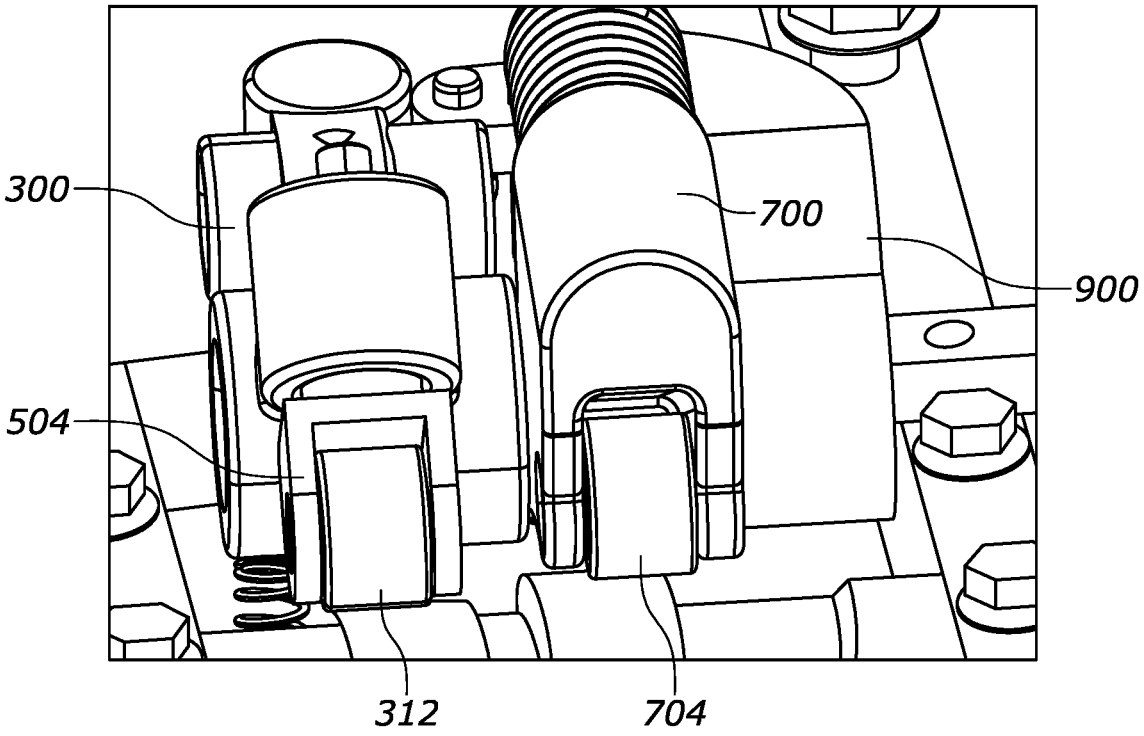
Figure 15:
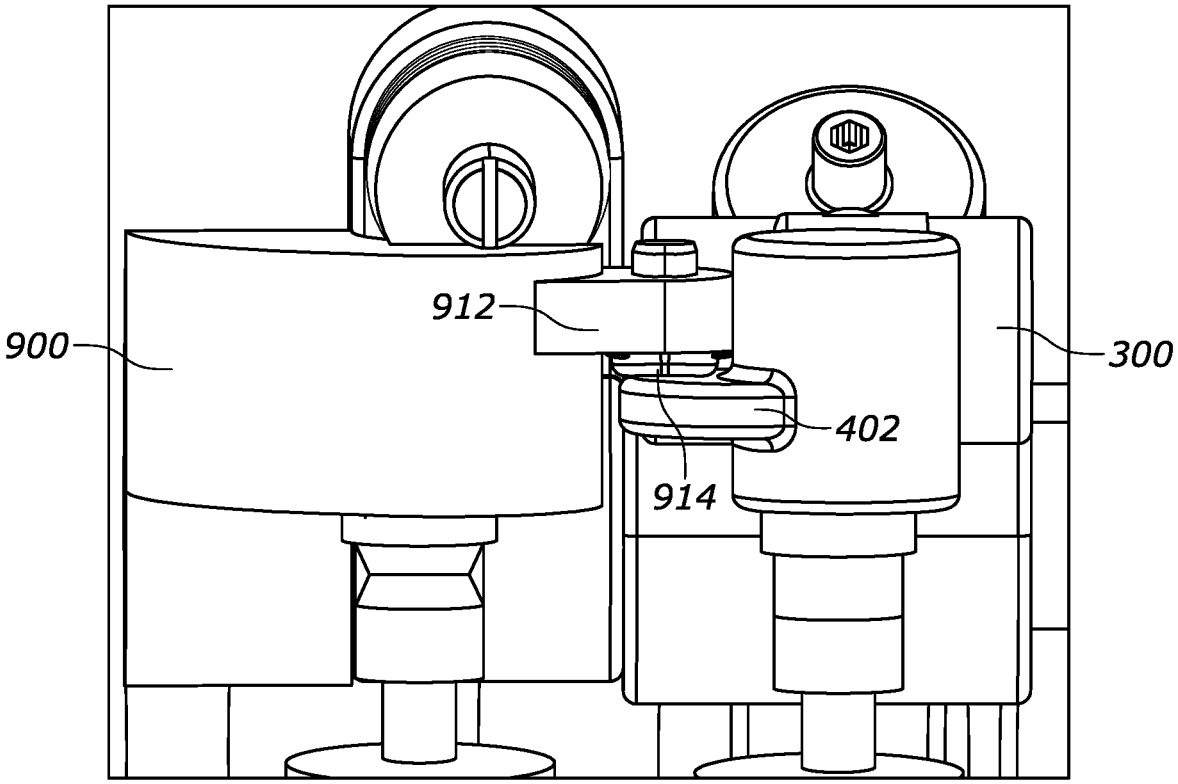

An example of a valve actuation system in accordance with the system illustrated in FIG. 2 and the rocker implementations of FIGS. 3-5 and 7-9 is further illustrated with regard to FIGS. 13-15. In this embodiment, the optional auxiliary motion source 214 and actuator 222 are not included. Thus, the first rocker arm 900 and the third rocker arm 700 are half-rockers. The third rocker arm 700, as best shown in FIG. 14, includes a roller follower 704. A bias spring 708 is disposed between the first and third rocker arms 900, 700, which spring biases the third rocker arm 700 into constant contact with the main motion source 210. Although obscured by the bias spring 708, in this embodiment, the third rocker arm 700 comprises a collapsing mechanism that may be extended to contact the first rocker arm 900. As will be appreciated by those skilled in the art, the bias spring 708 will place a load on any hydraulic lash adjuster included in the valve actuation system. If such bias was permitted in all circumstances, the hydraulic lash adjuster would eventually collapse to its minimum length state, which would confound the purpose of the hydraulic lash adjuster in the first place. Thus, to prevent this from occurring, a travel limiter may be included that limits the travel of the bias spring 708, i.e., such that it is prevent from continually applying a bias to the first and third rocker arms 900, 700. In this manner, collapse of the hydraulic lash adjuster is prevented, particularly when no valve actuation motions are being applied to the corresponding first engine valve, i.e., in the case of a cam providing the valve actuation motions, at base circle of the cam.

Further in this embodiment, the second rocker arm 300 comprises the actuator 504 at its motion receiving end, which actuator supports a roller follower 312 as shown. As best shown in FIG. 15, and similar to the embodiment illustrated in FIGS. 11 and 12, the first rocker arm 900 comprises an extension 912 extending in the direction of the second rocker arm 300 and the second rocker arm 300 comprises an extension 402 extending in the direction of the first rocker arm 900. Likewise, the extensions 912, 402 overlap each other such that valve actuation motions may be passed from the first rocker arm 900 to the second rocker arm 300, but not vice versa.

Figure 16:
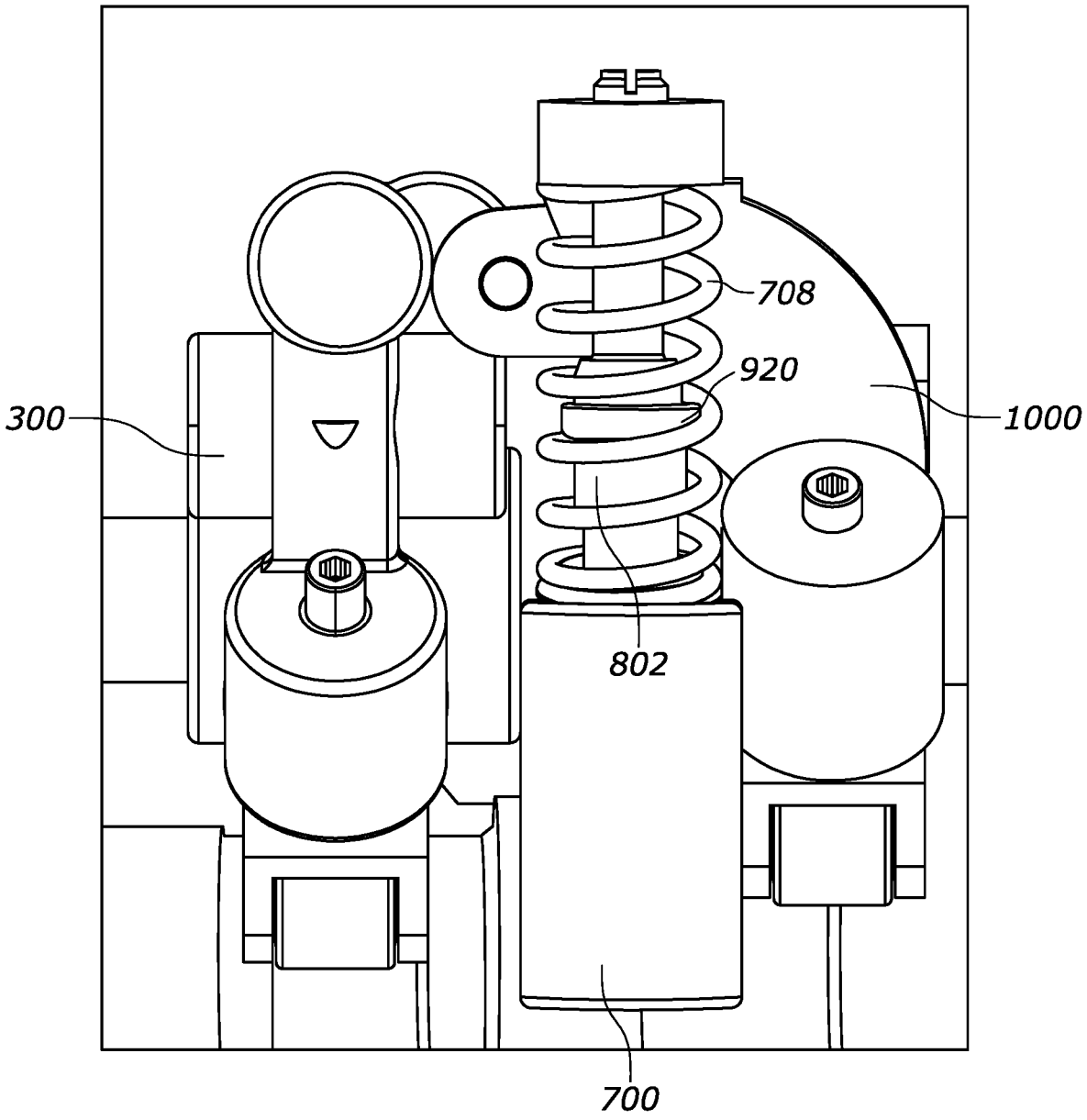
FIGS. 16-18 are respective top, rear and front views of a second example of a valve actuation system in accordance with the embodiments of FIGS. 2, 3-5, 7, 8 and 10.
Figure 17:
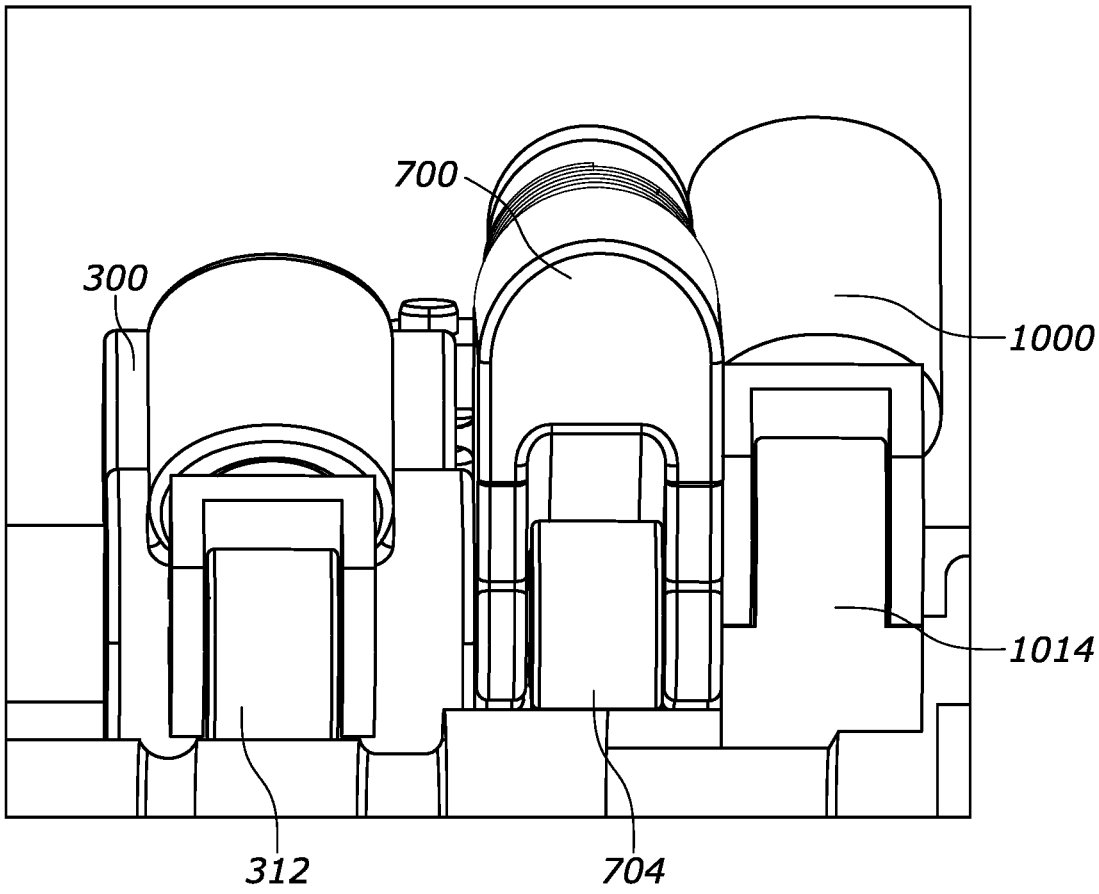
Figure 18:
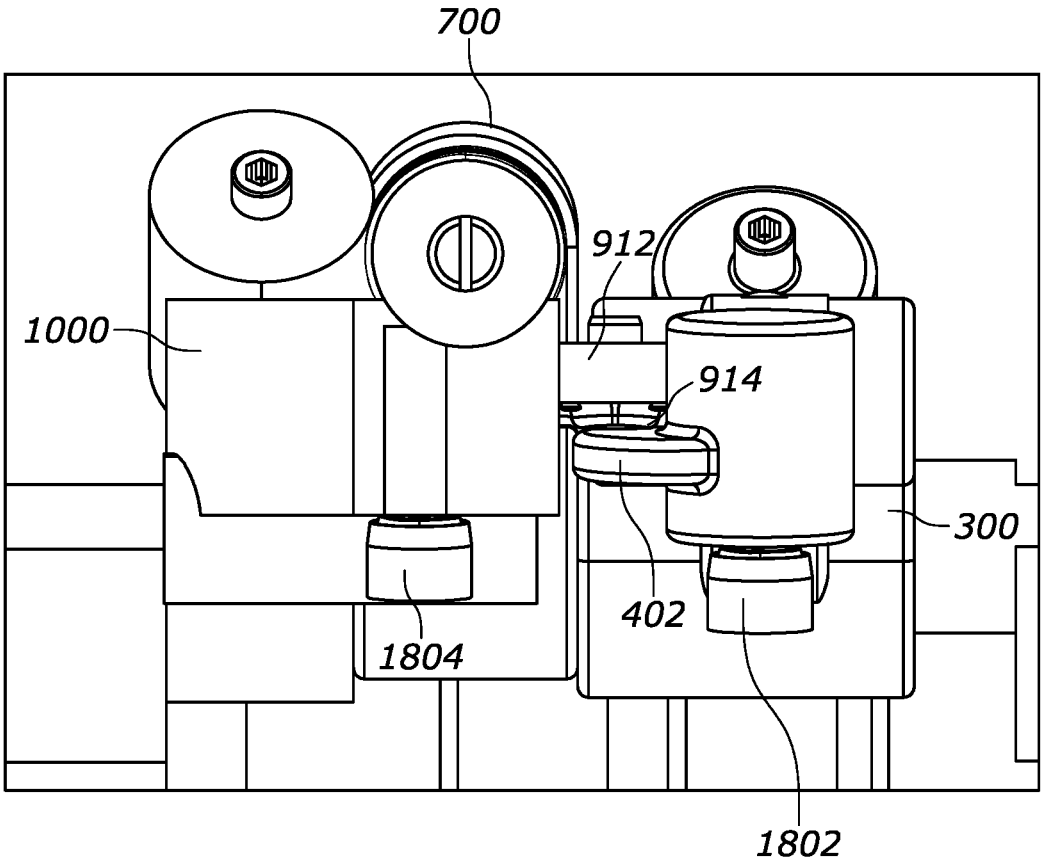

An example of a valve actuation system in accordance with the system illustrated in FIG. 2 and the rocker implementations of FIGS. 3-5, 7, 8 and 10 is further illustrated with regard to FIGS. 16-18. Components illustrated in the embodiment of FIGS. 16-18 are configured and operate in substantially the identical manner as like-numbered components illustrated in FIGS. 13-15, unless noted otherwise.

Unlike the embodiment of FIGS. 13-15, the first rocker arm 1000 includes a roller follower 1014 disposed on the second actuator 1010. Thus, as described above, the second actuator 1010 may be controlled to selectively pick up or lose auxiliary valve motions provided by the optional auxiliary motion source 214. Note that, in FIG. 16, the bias spring 708 is illustrated in an uncompressed state such that the collapsing mechanism 802 and collapsing mechanism contact surface 920 are visible. Additionally, in this embodiment and as best shown in FIG. 18, both the first the second rocker arms 1000, 300 respectively include a suitable pivot 1802, 1804 for engaging the engine valves (not shown), which swivels 1802, 1804 are mounted on corresponding hydraulic lash adjusters.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein. For example, though a particular implementation of the collapsing mechanism is described above, it is understood that other types of collapsing mechanisms could be employed.

What is claimed is:

1. A system for actuating at least two engine valves associated with a cylinder of an internal combustion engine, comprising:

at least one main rocker arm operatively connected to a first engine valve of the at least two engine valves to actuate the first engine valve, the at least one main rocker arm configured to receive at least main valve actuation motions from a main valve actuation motion source;

a second rocker arm operatively connected to a second engine valve of the at least two engine valves to actuate the second engine valve, the second rocker arm configured to receive first auxiliary valve actuation motions from a first auxiliary valve actuation motion source, the second rocker arm further comprising a hydraulically-controlled first actuator configured, in a first actuator first state, to couple the second rocker arm and the second engine valve thereby permitting conveyance of the first auxiliary valve actuation motions from the second rocker arm to the second engine valve and, in a first actuator second state, to decouple the second rocker arm and the second engine valve thereby preventing conveyance of the auxiliary valve actuation motions from the second rocker arm to the second engine valve; and a one-way coupling mechanism disposed between the at least one main rocker arm and the second rocker arm, at motion imparting ends of the at least one main rocker arm and the second rocker arm, such that the main valve actuation motions are transferred from the at least one main rocker arm to the second rocker arm, and the first auxiliary valve actuation motions are not transferred from the second rocker arm to the at least one main rocker arm.

2. The system of claim 1, further comprising a hydraulic lash adjuster disposed in a motion imparting end of the at least one main rocker arm.

3. The system of claim 1, further comprising a hydraulic lash adjuster disposed in a motion imparting end of the second rocker arm.

4. The system of claim 1, wherein the first actuator is disposed in a motion receiving end of the second rocker arm.

5. The system of claim 1, wherein the first actuator is disposed in a motion imparting end of the second rocker arm.

6. The system of claim 1, the one-way coupling mechanism comprising:

a first contact surface provided by the at least one main rocker arm; and a second contact surface provided by the second rocker arm, wherein the first and second contact surfaces are configured such that the main valve actuation motions cause contact between the first and second contact surfaces, whereas the first auxiliary valve actuation motions do not cause contact between the first and second contact surfaces.

7. The system of claim 6, the one-way coupling mechanism comprising:

a first extension extending from the at least one main rocker arm toward the second rocker arm and comprising the first contact surface; and a second extension extending from the second rocker arm toward the at least one main rocker arm and comprising the second contact surface.

8. The system of claim 6, wherein the first contact surface or the second contact surface comprises an adjustable contact surface.

9. The system of claim 1, wherein the at least one main rocker arm comprises:

a first rocker arm configured to actuate the first engine valve, wherein the one-way coupling mechanism is disposed between the first rocker arm and the second rocker arm at motion imparting ends of the first rocker arm and the second rocker arm;

a third half-rocker arm configured to receive the main valve actuation motions from the main valve actuation motion source; and a collapsing mechanism configured, in a first collapsing mechanism state, to couple the third half-rocker arm and the first rocker arm thereby permitting conveyance of the main valve actuation motions from the third half-rocker arm to the first rocker arm and, in a second collapsing mechanism state, to decouple the third half-rocker arm and the first rocker arm thereby preventing conveyance of the main valve actuation motions from the third half-rocker arm to the first and second rocker arm.

10. The system of claim 9, wherein the collapsing mechanism is disposed in the third half-rocker arm.

11. The system of claim 10, the first rocker arm comprising a collapsing mechanism contact surface.

12. The system of claim 9, wherein the collapsing mechanism is disposed in the first rocker arm.

13. The system of claim 9, the collapsing mechanism comprising a locking mechanism.

14. The system of claim 9, the third half-rocker arm comprising a resilient element contact surface configured to cooperatively engage with a resilient element for biasing the third half-rocker arm into contact with the main valve actuation motion source.

15. The system of claim 9, wherein the first rocker arm is a half-rocker arm.

16. The system of claim 15, further comprising a resilient element, disposed between the third half-rocker arm and the first rocker arm to bias the third half-rocker arm into contact with the main valve actuation motion source.

17. The system of claim 9, wherein the first rocker arm is configured to receive second auxiliary valve actuation motions from a second auxiliary valve actuation motion source.

18. The system of claim 17, the first rocker arm comprising a hydraulically-controlled second actuator configured, in a second actuator first state, to couple the first rocker arm and the first engine valve thereby permitting conveyance of the second auxiliary valve actuation motions from the first rocker arm to the first engine valve and, in a second actuator second state, to decouple the first rocker arm and the first engine valve thereby preventing conveyance of the second auxiliary valve actuation motions from the first rocker arm to the first engine valve.

* * * * *